United States Patent [19]

Dutcher

[11] 4,182,224

[45] Jan. 8, 1980

[54] METHOD OF INSTALLING PLASTIC WINDOW IN A BOX COVER

[75] Inventor: Daniel P. Dutcher, Woodbury, Minn.

[73] Assignee: Champion International Corporation, Stamford, Conn.

[21] Appl. No.: 883,149

[22] Filed: Mar. 3, 1978

[51] Int. Cl.[2] ..... B31B 1/82

[52] U.S. Cl. ..... 93/39 R; 93/36.6

[58] Field of Search ..... 93/36 B, 36.6, 39 R, 93/39.1 P, 55.1 P; 206/45.31, 45.34; 229/31 FS, 48 R

[56] References Cited

U.S. PATENT DOCUMENTS

| | | | |
|---|---|---|---|
| 2,147,614 | 2/1939 | Sidebotham | 93/36.6 X |
| 2,223,770 | 12/1940 | Nagle | 93/36.6 X |
| 3,038,650 | 6/1962 | Asman | 206/45.31 X |
| 3,040,961 | 6/1962 | Meyers | 206/45.31 X |

*Primary Examiner*—James F. Coan

*Attorney, Agent, or Firm*—Evelyn M. Sommer

[57] ABSTRACT

A method of installing a flexible, transparent plastic film in a box cover, where the box cover is made of a single blank having a top panel and four hingedly connected side flap panels, and with a central opening that is cut into the top panel as well as portions of each side flap panel includes the steps of opening the box cover blank to a flattened condition, and applying a selective pattern of adhesive on the inside surface of the blank. Next, the sheet of flexible transparent plastic is bonded to the inside surface of the paperboard blank by means of the adhesive, and then the side flap panels are folded upwardly and bonded together to form the box cover. During the folding operation, and by virtue of the placement of the adhesive connecting the flexible transparent plastic film to the blank of the box cover, the folded edges of the plastic film are rounded so as to result in the desired aesthetically pleasing box.

7 Claims, 4 Drawing Figures

METHOD OF INSTALLING PLASTIC WINDOW IN A BOX COVER

The subject invention relates to a new and improved method of installing a flexible transparent plastic film in a box cover, and more particularly a method of installing a transparent plastic film which functions as a window in a box cover so as to result in rounded corners of the plastic film thereby providing as aesthetically pleasing box cover.

It is a further object of the invention to provide a box cover wherein the transparent plastic film or window extends along the top of a box cover, as well as along each of the sides of the box cover, and is installed in the box cover in such a manner that the curved portions of the window between the top and side walls thereof are rounded for achieving an aesthetically pleasing construction. According to the subject method, the box cover is formed of a flexible transparent plastic film, and a paperboard blank which is die cut to include a central, generally rectangular top panel having hingedly connected thereto four side flap panels. The top panel includes a central, generally rectangular opening, with portions of the opening extending across the hinge lines and cut from portions of the side panels. Preferably, the generally rectangular central opening is offset 90° with respect to the axes of the generally rectangular top panel. In the subject process, the blank is placed in its flattened condition, face down, and four elongated strips of adhesive are applied to the inside surface of the blank adjacent each side edge of the central rectangular opening. Next, the sheet of plastic transparent film which is of a size greater than the size of the top panel and the central opening is bonded to the blank, and thus overlaps portions of the side flap panels of the blank. Adhesive is also applied to at least two opposed flaps of the blank, and each flap is preferably made of two hingedly connected segments which are folded together, followed by the four side panels being interengaged and bonded so as to complete the construction of the box cover. The portions of the flexible plastic film which extend across the hinge lines interconnecting the central panel to the side flap panels are bent to form aesthetically pleasing rounded corners, with the resulting box cover having a window whereby the products within the box may be observed from the top, as well as from all four sides of the box cover.

Further objects and advantages of the invention will become apparent from a reading of the following detailed specification taken in conjunction with the drawings in which.

Figure 1:
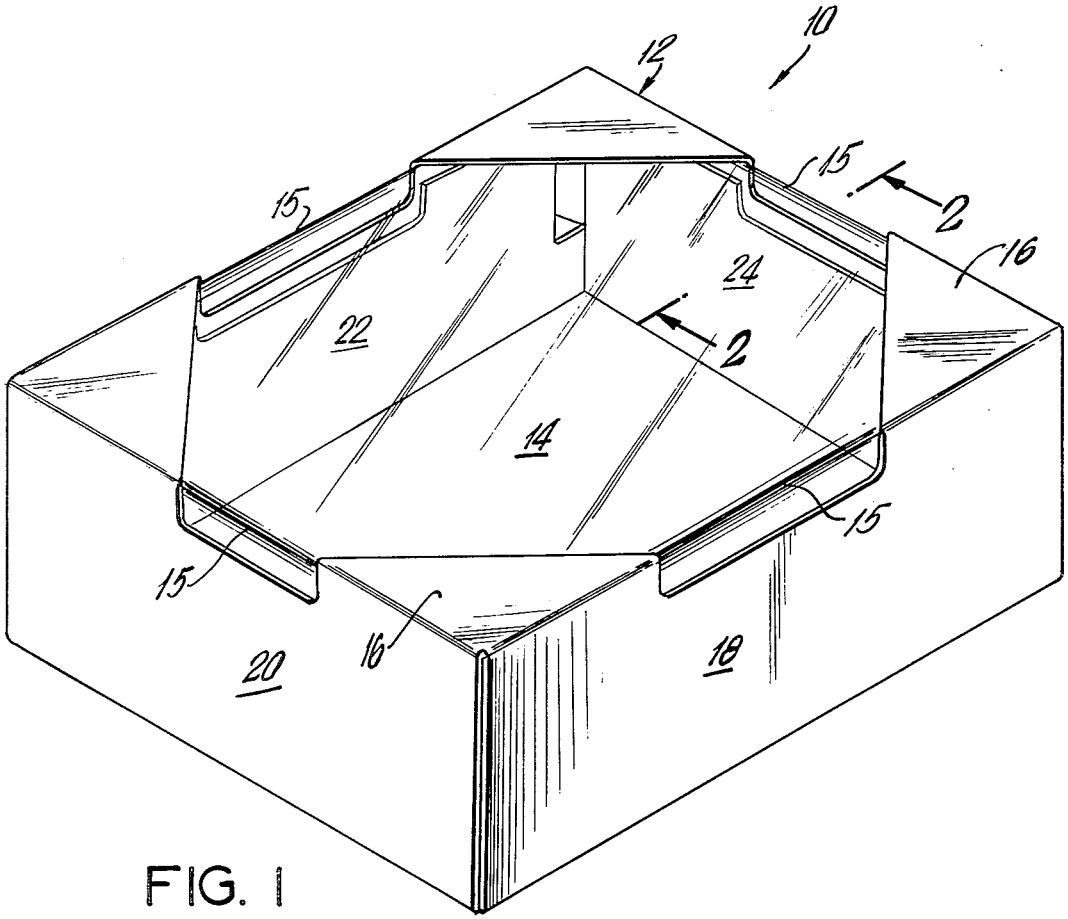
FIG. 1 is a perspective view of the resulting aesthetically pleasing box cover made according to the process of the subject invention.

Referring to FIG. 1, the box cover made according to the subject process is designated by the numeral 10 and basically comprises an opaque paperboard blank 12 and a window 14. The paperboard 12 includes a top panel 16, an open bottom, and four upstanding side walls designated by the numerals 18, 20, 22 and 24. The subject invention provides a new and improved process for installing the window 14 in the paperboard blank 12 to result in an aesthetically pleasing construction. More particularly, the subject process results in a construction wherein the window 14 extends at least across a portion of the top panel 16, as well as portions of the side panels 18 through 24, with the curved edges 15 of the window being rounded to achieve the aesthetically pleasing construction.

Figure 3:
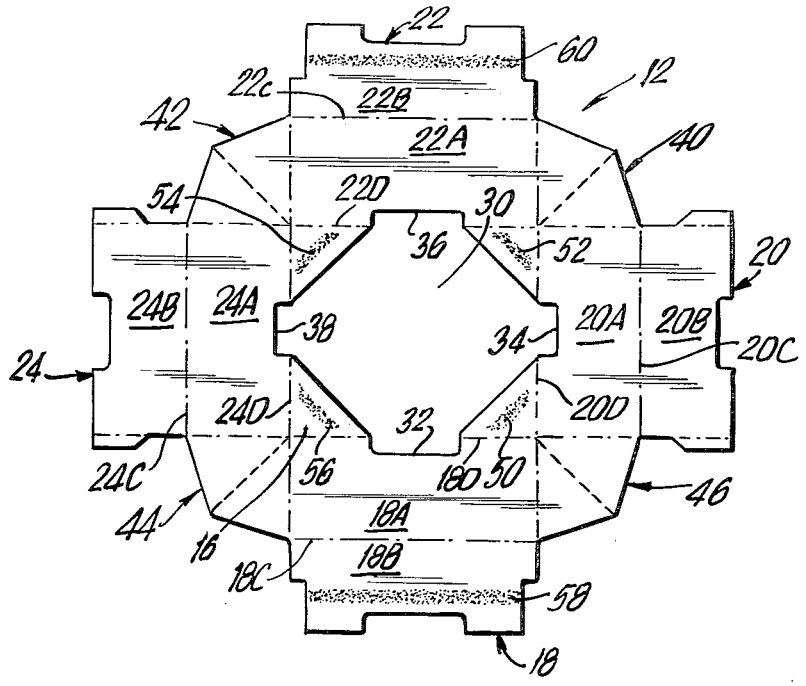
FIG. 3 illustrates the condition of the paperboard blank during one step of the subject process.

FIG. 3 illustrates the paperboard blank 12 in its flattened condition, and depicts the inner surface or underside of the paperboard blank 12 in an initial step of the subject process. As illustrated in FIG. 3, each side panel 18–24 of the paperboard blank 12 includes two segments designated by the letters "A," and "B," which are hingedly connected along hinge lines, designated by the letter "C," and, in turn, hingedly connected to the top panel 16 along a hinge line designated by the letter "D." Cut into the generally rectangular top panel 16 is a central opening 30 that is generally rectangular in configuration, and is preferably offset 90° with respect to the axes of the top panel 16. Still further, the central opening 30 includes enlarged corner portions 32–38 which extend across the hinge lines 18D, 20D, 22D, and 24D that interconnect the top panel 16 to the side wall panels. The enlarged corner portions 32–38 insure that visability through the window 14 is afforded both through the top panel 16, and also partially through the side wall panels. Interconnecting the adjacent side wall panels are tuck flaps 40–46, each of which is made of two hingedly connected triangular segments that, in turn, are hingedly connected to the respective side wall panels.

In the first step of the subject process, the paperboard blank 12 is positioned in its flattened condition as illustrated in FIG. 3, and with the underside of the paperboard blank being face up. Next, strips of adhesive material designated by the numeral 50, 52, 54 and 56 are applied along the opposed edges of the central opening 30. The elongated adhesive strips 50–56 are of a suitable composition for bonding the flexible plastic window 14 to the paperboard blank 12. As illustrated in FIG. 3, the elongated adhesive strips 50 through 56 extend between the enlarged corner portions 32–38 and are generally parallel to the opposed edges of the central opening 30.

Figure 2:
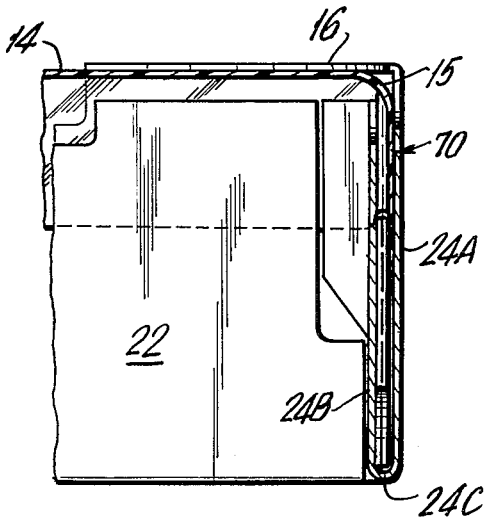
FIG. 2 is a sectional view taken along line 2—2 in FIG. 1.
Figure 4:
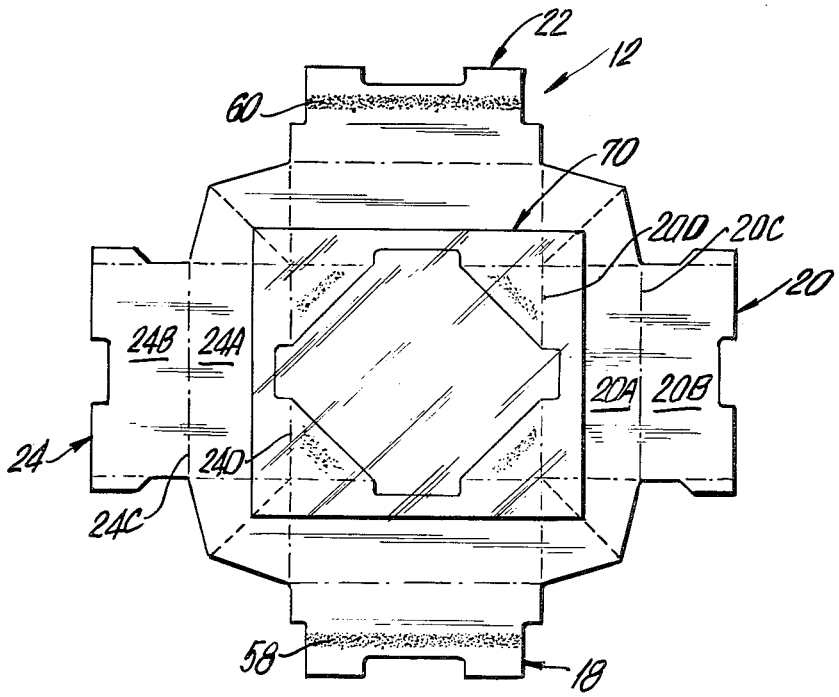
FIG. 4 illustrates a subsequent step in the subject process.

FIG. 4 illustrates the next step in the subject process wherein a flexible, transparent plastic film sheet 70 which is of greater size than the area of central opening 30 (including the enlarged corner portions 32–38), and is also of sufficient size to overlap the hinge lines 18D, 20D, 22D, and 24D, is placed against the inside surface of the paperboard blank 21 and bonded thereto by means of the adhesive strips 50–56. At this time, or in the preceding step as illustrated in FIG. 3, additional strips of adhesive 58 and 60 may be provided on the end panels 18B and 22B. The latter adhesive strips are employed in securing the side walls to the final configuration of the box cover as illustrated in FIG. 1. More particularly, segments 20B and 24B are folded about hinge lines 20C and 24C so as to overlap the opposed edges of the flexible transparent plastic film 70. Next, side walls 20 and 24 are folded about hinge lines 20D and 24D, and the tuck flaps 40–46 are folded about their central fold lines and are rotated so as to be in a position to be contiguous with the segments 18A and 22A of the opposed flaps 18 and 22. The segments 18B and 22B are folded about hinge lines 18C and 22C so as to overlap the tuck flaps 44–46 and 40–42 as well as the opposed edges of the plastic film 70, and at such time the outer segments 18B and 22B are adhered to the inner segments 18A and 22A, respectively, by means of adhesive strips 58 and 60. Accordingly, the side walls are interlocked and maintained in a fixed position orthagonal to the top panel 16 in the final configuration as shown in FIGS. 1 and 2. As clearly illustrated in FIG. 2, the corners 15 of the plastic film 70 are rounded thereby providing as aesthetically pleasing box cover configuration. In addition, the opposite edges of the plastic film sheet 70 are disposed between the overlapping segments of the side walls.

Accordingly, there is provided a new and improved method of installing a window in the form of a flexible transparent plastic film to a single paperboard blank having a central opening that includes enlarged corner portions that are cut into the side walls of the box cover. The resulting construction has structural integrity, is aesthetically pleasing, and may be practiced using conventional automatic manufacturing equipment for die cutting and erecting paperboard structures.

What is claimed is:

1. A method of installing a flexible transparent plastic film in a box cover, said box cover including a blank made of opaque material and having a generally rectangular top panel hingedly connected to four side flap panels each provided with an inner and an outer segment hingedly attached to each other, and with said top panel having a central, generally rectangular opening therein, said blank further having tuck flaps each provided with a pair of hinged members hingedly connecting adjacent flap panels, said method comprising the steps of:

placing the blank in its flattened condition and applying adhesive means on the inside surface of the blank adjacent the rectangular opening;

providing the sheet of flexible transparent plastic film having a size greater than the size of said top panel and said central opening such that said flexible transparent plastic film overlaps the side flap panels and the tuck flaps of the blank;

bonding said sheet of flexible transparent plastic film to the inner surfaces of said blank using said adhesive means; and simultaneously folding the side flaps and the tuck flaps of said blank to a generally orthagonal position relative to the plane of the top panel, said hinged members of each of said tuck flaps being folded into overlapping relationship with each other with portions of the edges of said film disposed on opposite sides of each of said pair of said overlapping hinge members.

then, folding and securing the outer segment of each of said side flap panels into overlapping relationship with the respectively associated inner segment whereby to enclose sections of said edges of said film between said inner and outer segments, each pair of said overlapping tuck flap members being interposed between the inner and outer segments of at least certain ones of said side flap panels with said film edge portions sandwiched between said tuck flap members and the panel segments of said certain side flap panels whereby to securely hold said film in position over said rectangular opening.

2. A method of installing a flexible transparent plastic film in a box cover as set forth in claim 1 wherein said side flaps are adhesively bonded to insure the structural integrity of the box cover.

3. A method of installing a flexible transparent plastic film in a box cover as set forth in claim 1 wherein said central opening is configured to partially extend into each side flap of the blank.

4. A method of installing a flexible transparent plastic film in a box cover as set forth in claim 1 wherein said blank is formed of a paperboard material.

5. A method of installing a flexible transparent plastic film in a box cover as set forth in claim 1 wherein said central opening is offset 90° with respect to the axes of the top panel.

6. A method of installing a flexible transparent plastic film in a box cover as set forth in claim 1 wherein said top panel is generally square, said central opening is generally square and is offset approximately 90° relative to said square top panel, and said central opening includes enlarged portions at the corners thereof, which enlarged corner portions extend respectively along the hinge lines of said side flap panels to the top panel whereby the resulting box cover includes rounded corners of transparent plastic film along each side edge thereof.

7. A method of installing a flexible transparent plastic film in a box cover as set forth in claim 1 further including the step of applying adhesive to the inside surface of two opposed side flap panels prior to the step of folding and securing said panels.

* * * * *